US012680485B2

(12) United States Patent
Bräuning et al.

(10) Patent No.: US 12,680,485 B2
(45) Date of Patent: Jul. 14, 2026

(54) EXHAUST-GAS TREATMENT ARRANGEMENT

(71) Applicant: Purem GmbH, Neunkirchen (DE)

(72) Inventors: Silas Bräuning, Denkendorf (DE); Wolfgang Datz, Tuebingen (DE); Markus Henzler, Grafenberg (DE); Oleksandr Velyaev, Stuttgart (DE); Tobias Wolf, Koengen (DE); Arthur Wieland, Baltmannsweiler (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 18/528,504

(22) Filed: Dec. 4, 2023

(65) Prior Publication Data

US 2024/0183297 A1 Jun. 6, 2024

(30) Foreign Application Priority Data

Dec. 5, 2022 (DE) ..... 10 2022 132 123.1

(51) Int. Cl.
*F01N 3/08* (2006.01)
*F01N 13/00* (2010.01)

(52) U.S. Cl.
CPC ..... *F01N 3/0835* (2013.01); *F01N 13/001* (2013.01); *F01N 2610/03* (2013.01)

(58) Field of Classification Search
CPC .... F01N 3/2053; F01N 13/009; F01N 3/0878; F01N 2410/00; F01N 2240/36;
(Continued)

(56) References Cited

U.S. PATENT DOCUMENTS 8,756,927 B2 6/2014 Doering
11,268,420 B2 3/2022 Voss et al.
(Continued)

FOREIGN PATENT DOCUMENTS

DE 10 2004 036 036 A1 3/2006
DE 10 2009 041 345 A1 4/2011
(Continued)

OTHER PUBLICATIONS

DE-202013102882-U1 Machine Translation (Year: 2013).*
JP-2013002398-A Machine Translation (Year: 2013).*

*Primary Examiner* — Anthony Ayala Delgado
(74) *Attorney, Agent, or Firm* — Walter Ottesen, P.A.

(57) ABSTRACT

An exhaust-gas treatment arrangement for an exhaust gas system of an internal combustion engine includes a first exhaust-gas treatment unit and an exhaust-gas treatment assembly being arranged axially one after the other in the direction of a longitudinal axis of a flow path. The flow path includes the first exhaust-gas treatment unit and the exhaust-gas treatment assembly. A hydrocarbon introduction assembly for introducing hydrocarbon into exhaust gas flowing through the exhaust-gas treatment arrangement is provided. The hydrocarbon introduction assembly includes a bypass flow channel which includes a flow-channel inlet region for receiving exhaust gas upstream of the first exhaust-gas treatment unit and a flow-channel outlet region for discharging exhaust gas or/and hydrocarbon into the flow path downstream of the first exhaust-gas treatment unit and upstream of the exhaust-gas treatment assembly. The hydrocarbon introduction assembly includes a hydrocarbon discharging unit for discharging hydrocarbon into the bypass flow channel.

29 Claims, 3 Drawing Sheets

(58) Field of Classification Search
CPC .. F01N 3/0871; F01N 13/011; F01N 2610/03; F01N 3/025; F01N 2570/12
See application file for complete search history.

(56) References Cited

U.S. PATENT DOCUMENTS

| | | | | |
|---|---|---|---|---|
| 2005/0013756 | A1 | 1/2005 | Amou et al. | |
| 2006/0260297 | A1 | 11/2006 | Koch | |
| 2009/0031711 | A1 | 2/2009 | Braun et al. | |
| 2010/0037607 | A1* | 2/2010 | Doring | F02B 37/164 60/287 |
| 2010/0251700 | A1 | 10/2010 | Wan et al. | |
| 2015/0027104 | A1* | 1/2015 | Bush | F01N 3/0253 60/274 |

FOREIGN PATENT DOCUMENTS

| | | | | |
|---|---|---|---|---|
| DE | 202013102882 | U1 * | 9/2013 | F01N 13/009 |
| EP | 1 481 719 | A2 | 12/2004 | |
| JP | 2013002398 | A * | 1/2013 | |

* cited by examiner

EXHAUST-GAS TREATMENT ARRANGEMENT

CROSS-REFERENCE TO RELATED APPLICATIONS

This application claims priority of German patent application no. 10 2022 132 123.1, filed Dec. 5, 2022, the entire content of which is incorporated herein by reference.

TECHNICAL FIELD

The present disclosure relates to an exhaust-gas treatment arrangement for an exhaust gas system of an internal combustion engine, in particular a diesel internal combustion engine.

BACKGROUND

To achieve permissible exhaust-gas values for the exhaust gases given off by internal combustion engines, in particular diesel internal combustion engines, it is known, for example, to spray a reactant, such as a urea/water solution, into the exhaust gas in order to reduce the nitrogen oxide content in an exhaust-gas treatment unit, in particular in the form of a SCR catalytic converter unit. It is also known to combine different types of catalytic converters, such as SCR catalytic converter units and oxidation catalytic converter units, in such an exhaust-gas treatment arrangement, in order to achieve as efficient as possible a reduction in the proportion of pollutants in the exhaust gas given off into the surroundings.

For the catalytic reactions that are to be conducted in various system regions of such an exhaust-gas treatment arrangement, it is necessary for the catalyst materials active in these reactions to have a sufficiently high temperature. Since, especially in starting phases of the operation of an internal combustion engine or at comparatively low ambient temperatures, the heat transported in the exhaust gas is often not sufficient to quickly reach, or reliably maintain, a temperature high enough for the catalytic reactions that are to be conducted, it is known, for example, to integrate electrically operated exhaust gas heaters in an exhaust gas system in order to transfer heat to the exhaust gas given off by an internal combustion engine, or another gas introduced in the exhaust gas system, upstream of one or more catalytically active system regions, the heat then being transported to the one or more catalytically active system regions and transferred to them by the exhaust gas, or gas.

SUMMARY

It is an object of the present disclosure to provide an exhaust-gas treatment arrangement for an exhaust gas system of an internal combustion engine, in particular diesel internal combustion engine, which makes it possible to ensure reliable heating of system regions intended for exhaust gas treatment along with a structurally straightforward and compact configuration.

This object is, for example, achieved according to the disclosure by an exhaust-gas treatment arrangement for an exhaust gas system of an internal combustion engine, in particular diesel internal combustion engine, including at least one first exhaust-gas treatment unit and, downstream of the at least one first exhaust-gas treatment unit, an exhaust-gas treatment assembly, the at least one first exhaust-gas treatment unit and the exhaust-gas treatment assembly being arranged axially one after the other in the direction of a flow-path longitudinal axis of a flow path including the at least one first exhaust-gas treatment unit and the exhaust-gas treatment assembly, a hydrocarbon introduction assembly for introducing hydrocarbon into exhaust gas flowing through the exhaust-gas treatment arrangement being provided, the hydrocarbon introduction assembly including at least one bypass flow channel, the at least one bypass flow channel including a flow-channel inlet region for receiving exhaust gas upstream of the at least one first exhaust-gas treatment unit and a flow-channel outlet region for discharging exhaust gas or/and hydrocarbon into the flow path downstream of the at least one first exhaust-gas treatment unit and upstream of the exhaust-gas treatment assembly, and the hydrocarbon introduction assembly including a hydrocarbon discharging unit for discharging hydrocarbon into the at least one bypass flow channel.

Providing the hydrocarbon introduction assembly formed according to the disclosure affords the possibility of introducing hydrocarbon, which releases heat as it oxidizes and therefore contributes to the heating of system regions intended for exhaust gas treatment, that is, for example, the fuel that is also to be supplied to an internal combustion engine, into the exhaust gas flow and efficiently mixing it with exhaust gas. Since the at least one bypass flow channel receives only some of the exhaust gas introduced into the exhaust-gas treatment arrangement, while the rest of the exhaust gas introduced into the exhaust-gas treatment arrangement flows though the flow path upstream of the entrance of the at least one bypass flow channel, the hydrocarbon introduced into the at least one bypass flow channel is mixed with a quantity of exhaust gas which is relatively small compared with the total quantity of exhaust gas introduced into the exhaust-gas treatment arrangement, this assisting uniform mixing of exhaust gas and hydrocarbon in the at least one bypass flow channel.

In order to be able to branch off some of the exhaust gas flowing through the exhaust-gas treatment arrangement upstream of the at least one first exhaust-gas treatment unit, it may be provided that an upstream end region of the flow path adjoins an introduction housing, and wherein the flow-channel inlet region of the at least one bypass flow channel adjoins the introduction housing for the purpose of receiving exhaust gas from the introduction housing or/and adjoins a portion of the flow path that lies between the introduction housing and the at least one first exhaust-gas treatment unit for the purpose of receiving exhaust gas from the flow path.

To assist the mixing of exhaust gas and hydrocarbon in the bypass flow channel, at least one swirling-flow generating unit can be arranged in the at least one bypass flow channel.

If at least one swirling-flow generating unit is arranged upstream of the hydrocarbon discharging unit, the exhaust-gas flow in the bypass flow channel is swirled, or made to swirl, already upstream of the location where the hydrocarbon is introduced into the exhaust gas flowing through the bypass flow channel, and in this state can then entrain the hydrocarbon introduced into it. If it is alternatively or additionally provided that at least one swirling-flow generating unit is arranged downstream of the hydrocarbon discharging unit, the mixture of exhaust gas and hydrocarbon is efficiently swirled and mixed downstream of the location where the hydrocarbon is introduced into the exhaust gas.

In order to be able to regulate the amount of that portion of the exhaust gas flowing through the exhaust-gas treatment arrangement that is conducted through the at least one bypass flow channel, an exhaust-gas regulating unit can be assigned to the at least one bypass flow channel.

For example, the exhaust-gas regulating unit may include a butterfly valve which, depending on the valve position, can, for example, substantially completely prevent flow through the at least one bypass flow channel or allow flow to occur through the at least one bypass flow channel to a maximum extent, or throttle the exhaust gas flow in the at least one bypass flow channel in a valve position which is between these two end positions.

To obtain a compact structure, it is proposed that the at least one bypass flow channel includes a flow channel portion extending in the direction of a flow-channel longitudinal axis that is substantially parallel to the flow-path longitudinal axis, and wherein the hydrocarbon discharging unit is configured to discharge hydrocarbon into the flow channel portion.

To further reduce the proportion of pollutants present in the exhaust gas given off by an internal combustion engine, at least one second exhaust-gas treatment unit may be arranged downstream of the exhaust-gas treatment assembly.

In order to be able to efficiently conduct a catalytic purification reaction in the at least one second exhaust-gas treatment unit, an exhaust-gas/reactant mixing section having a mixing channel, which is elongate substantially in the direction of a mixing-section longitudinal axis, and a reactant discharging unit for discharging reactant into the mixing channel may be provided downstream of the exhaust-gas treatment assembly and upstream of the at least one second exhaust-gas treatment unit.

For a compact configuration of the exhaust-gas treatment arrangement, it is proposed that the mixing-section longitudinal axis is substantially parallel to the flow-path longitudinal axis, or/and wherein the flow path and the exhaust-gas/reactant mixing section overlap one another substantially completely in the axial direction, with the result that an inlet region of the exhaust-gas/reactant mixing section is positioned substantially in the same axial region in the direction of the mixing-section longitudinal axis as an outlet region of the exhaust-gas treatment assembly, and an outlet region of the exhaust-gas/reactant mixing section is positioned substantially in the same axial region in the direction of the mixing-section longitudinal axis as an inlet region of the at least one first exhaust-gas treatment unit.

Efficient utilization of the structural volume provided for the exhaust-gas treatment arrangement can be achieved if an exhaust-gas main flow direction in the mixing channel is aligned substantially in the opposite direction to an exhaust-gas main flow direction in the flow path.

For this, it is also possible for the at least one second exhaust-gas treatment unit to be elongate in the direction of an exhaust-gas-treatment-unit longitudinal axis substantially parallel to the flow-path longitudinal axis and to be able to be flowed through substantially in the direction of the exhaust-gas-treatment-unit longitudinal axis, and the at least one second exhaust-gas treatment unit and the exhaust-gas/reactant mixing section can overlap one another substantially completely in the axial direction, with the result that the inlet region of the exhaust-gas/reactant mixing section is positioned substantially in the same axial region in the direction of the mixing-section longitudinal axis as an outlet region of the at least one second exhaust-gas treatment unit, and the outlet region of the exhaust-gas/reactant mixing section is positioned substantially in the same axial region in the direction of the mixing-section longitudinal axis as an inlet region of the at least one second exhaust-gas treatment unit.

To provide a flow connection, the inlet region of the exhaust-gas/reactant mixing section can be connected to the outlet region of the exhaust-gas treatment assembly via a first flow deflection housing, and the outlet region of the exhaust-gas/reactant mixing section can be connected to the inlet region of the at least one second exhaust-gas treatment unit via a second flow deflection housing.

To increase the exhaust-gas treatment efficiency with a compact structure, at least two second exhaust-gas treatment units, which can be flowed through in parallel, may be provided next to one another transversely in relation to the exhaust-gas-treatment-unit longitudinal axis and so as to substantially completely overlap one another in the direction of the exhaust-gas-treatment-unit longitudinal axis.

At least one exhaust-gas treatment unit may include at least one SCR catalytic converter unit or/and at least one ammonia slip catalytic converter unit. The exhaust-gas treatment assembly may also include an oxidation catalytic converter unit or/and a particle filter unit.

A compact structure of the exhaust-gas treatment arrangement formed according to the disclosure can also be assisted in that the flow-channel inlet region is positioned in the same axial region as an inlet region of the at least one first exhaust-gas treatment unit, and the flow-channel outlet region lies axially between the at least one first exhaust-gas treatment unit and the exhaust-gas treatment assembly.

To further assist the mixing of exhaust gas and reactant, a swirling-flow generating unit, preferably having a plurality of flow deflection elements extending substantially radially in relation to the flow-path longitudinal axis, may be arranged at an outlet region of the at least one first exhaust-gas treatment unit.

In order to be able to achieve as uniform as possible an entry of exhaust gas or hydrocarbon over the cross section of the exhaust-gas treatment assembly, it is proposed that a flow distribution element having a multiplicity of flow through-openings, preferably with substantially the same dimensions or/and distributed substantially evenly on the flow distribution element, is arranged at an inlet region of the exhaust-gas treatment assembly.

The disclosure also relates to an exhaust gas system for an internal combustion engine, in particular diesel internal combustion engine, including at least one exhaust-gas treatment arrangement formed according to the disclosure.

BRIEF DESCRIPTION OF DRAWINGS

The invention will now be described with reference to the drawings wherein.

DETAILED DESCRIPTION

Figure 1:
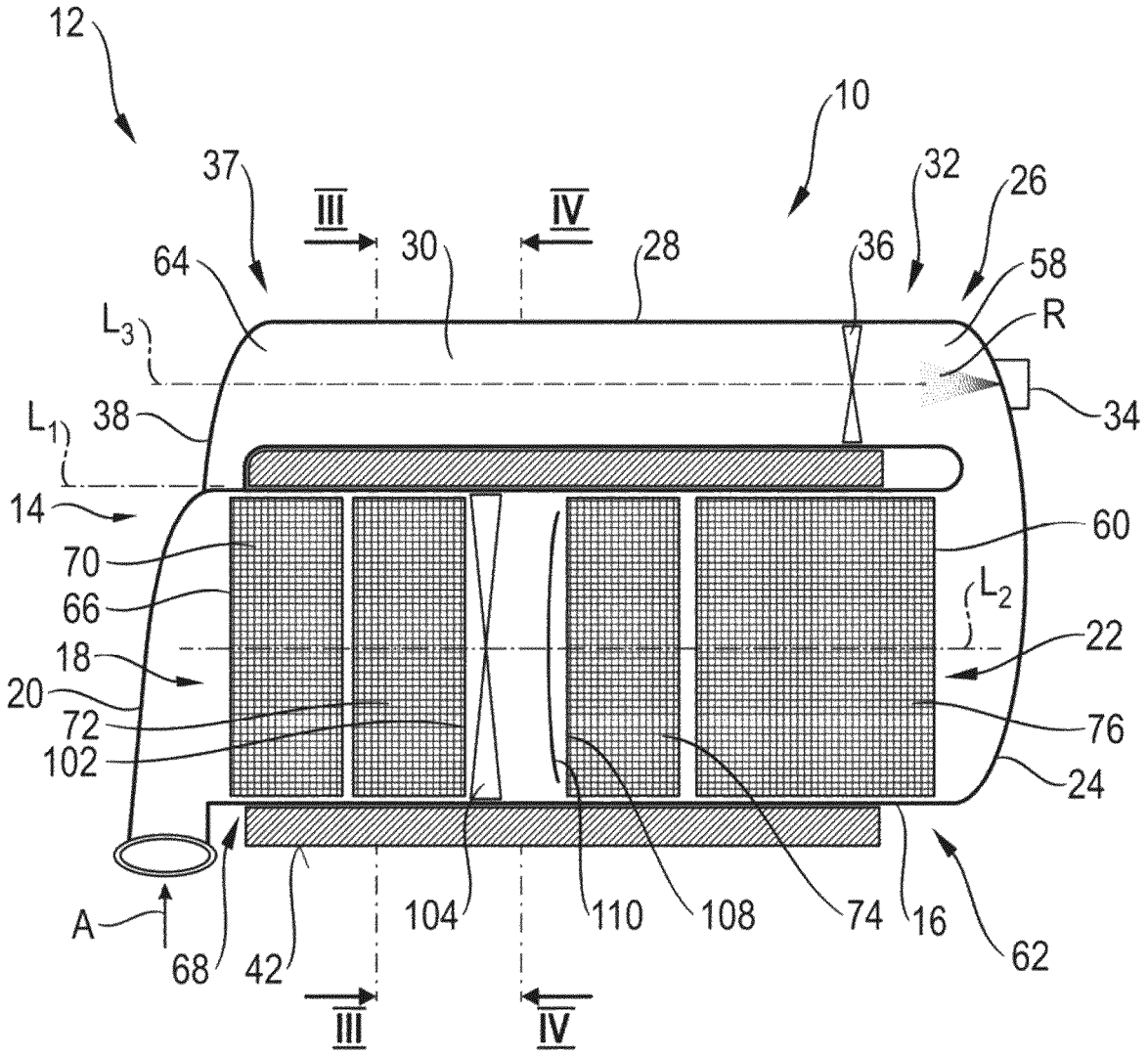
FIG. 1 shows a side view, in a partially open illustration, of an exhaust-gas treatment unit for an internal combustion engine.
Figure 2:
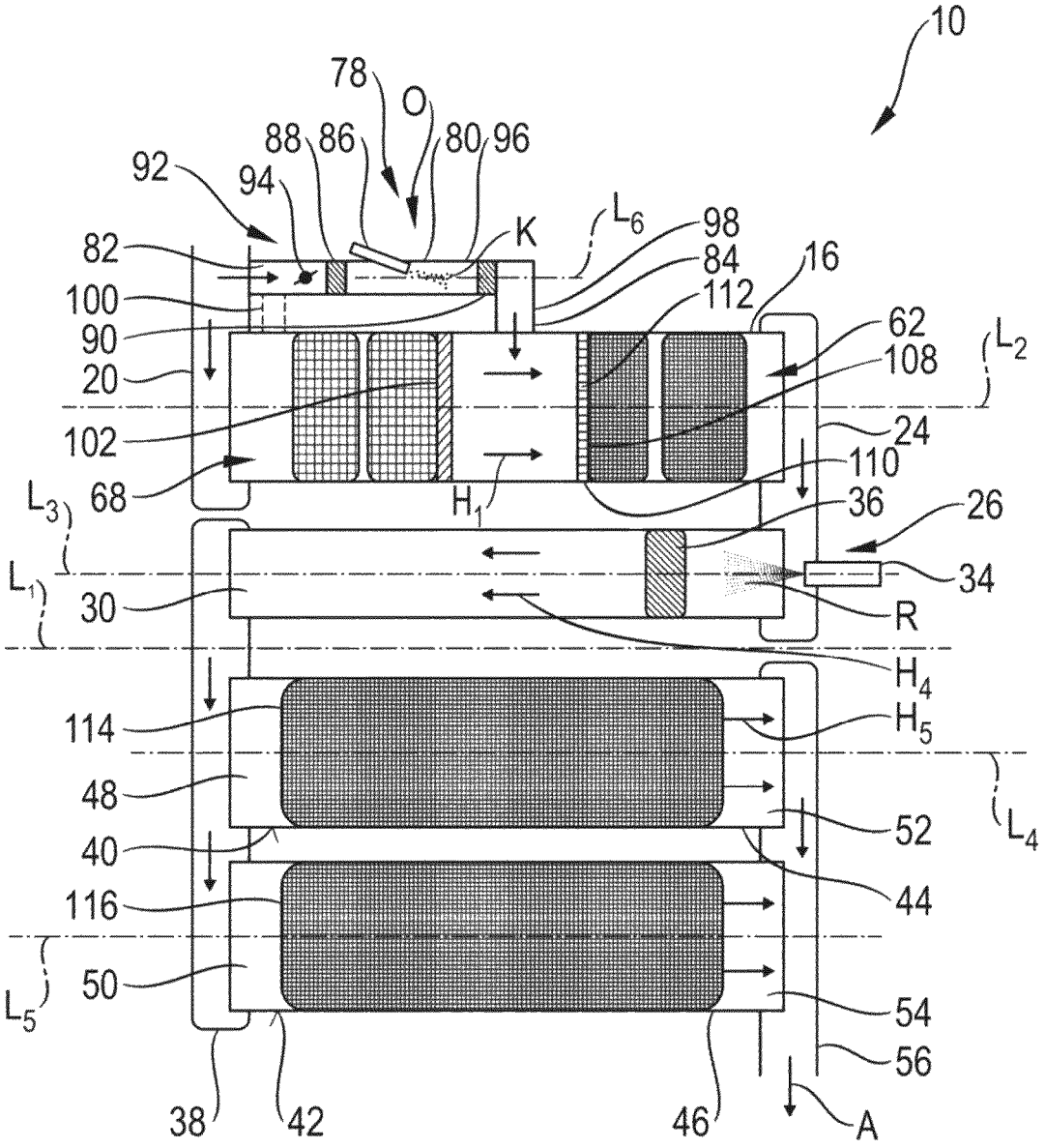
FIG. 2 shows a schematic and developed illustration of the system regions of the exhaust-gas treatment arrangement of FIG. 1, which follow one another in the flow direction and overlap one another substantially axially.
Figure 3:
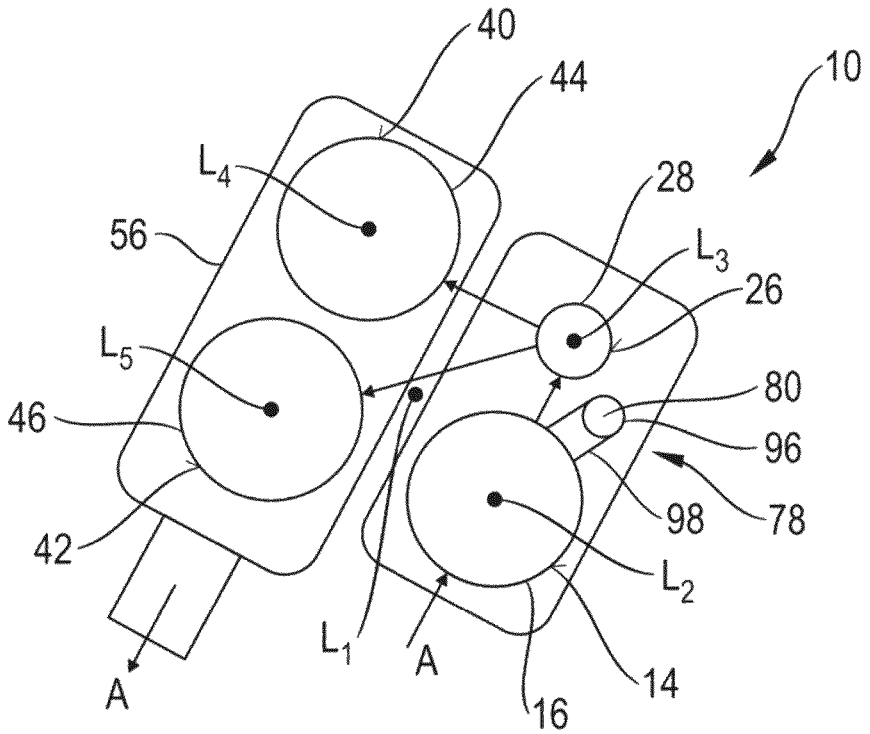
FIG. 3 shows a schematic cross-sectional view of the exhaust-gas treatment arrangement of FIG. 1 in section along a line III-III in FIG. 1; and, FIG. 4 shows a perspective cross-sectional view of the exhaust-gas treatment arrangement of FIG. 1 in section along a line IV-IV in FIG. 1.
Figure 4:
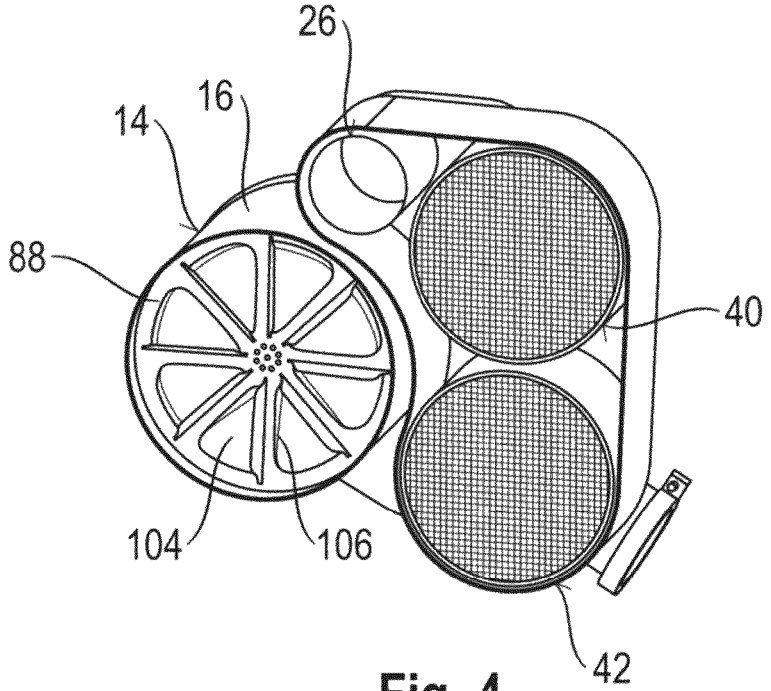

An exhaust-gas treatment arrangement 10 for an exhaust gas system 12, in particular for a diesel internal combustion engine, can be seen in a side view in FIG. 1. Such an exhaust-gas treatment arrangement 10 can be provided for example in an exhaust gas system 12 of a utility vehicle or a truck. FIGS. 2 and 3 illustrate the exhaust-gas treatment arrangement 10 in a schematic view, with FIG. 2 illustrating a circumferential embodiment of the exhaust-gas treatment arrangement 10, which is fundamentally elongate in the direction of an exhaust-gas-treatment-arrangement longitudinal axis $L_1$.

The exhaust-gas treatment arrangement 10 includes a flow path which is denoted 14 in general, is elongate in the direction of a flow-path longitudinal axis $L_2$, and has a substantially tubular flow-path housing 16 which is in one piece or composed of multiple parts. An introduction housing 20 adjoins the flow-path housing 16 at an upstream end region 18 of the flow path 14. Exhaust gas A given off by an internal combustion engine is introduced into the exhaust-gas treatment arrangement 10 or the flow path 14 via the introduction housing 20. A first deflection housing 24 adjoins the flow-path housing 16 in a downstream end region 22 of the flow path 14. In the first deflection housing 24, the exhaust gas A flowing through, or exiting, the flow path 14 is deflected by approximately 180° and introduced into an exhaust-gas/reactant mixing section 26. The exhaust-gas/reactant mixing section 26 includes a mixing channel 30, which is elongate in the direction of a mixing-section longitudinal axis $L_3$, in a tubular mixing-section housing 28. A reactant discharging unit 34, which in general is also referred to as injector and which sprays a reactant R, for example a urea/water solution, into the mixing channel 30, is provided at an upstream end region 32 of the exhaust-gas/reactant mixing section 26, for example carried on the first deflection housing 24. To assist the mixing of exhaust gas A and reactant R, a mixer 36 including, for example, a plurality of baffle plates or the like may be arranged in the mixing-section housing 28.

The mixing-section housing 28 adjoins a second deflection housing 38 in a downstream end region 37 of the exhaust-gas/reactant mixing section 26. The exhaust gas flow is deflected again by approximately 180° in the second deflection housing 38. In the embodiment illustrated, the exhaust gas is introduced into two second exhaust-gas treatment units 40, 42, which can be flowed through in parallel, via the second deflection housing 38. Each of the second exhaust-gas treatment units 40, 42 includes a tubular exhaust-gas-treatment-unit housing 44, 46 which is elongate in the direction of a respective exhaust-gas-treatment-unit longitudinal axis $L_4$, $L_5$. A respective upstream end region of the exhaust-gas-treatment-unit housing 44, 46 provides a respective inlet region 48, 50 of the second exhaust-gas treatment units 40, 42, and a respective downstream end region of the exhaust-gas-treatment-unit housing 44, 46 provides a respective outlet region 52, 54 of the second exhaust-gas treatment units 40, 42. They are open toward a discharge housing 56, via which the exhaust gas A treated in the exhaust-gas treatment arrangement 10 leaves the exhaust-gas treatment arrangement 10 toward further system regions of the exhaust gas system 12, for example one or more noise dampers or the like.

FIGS. 1 and 3 show that, in the exhaust-gas treatment arrangement 10, the flow path 14, the exhaust-gas/reactant mixing section 26 and the second exhaust-gas treatment units 40, 42 are positioned in such a way that their longitudinal axes $L_2$, $L_3$, $L_4$, $L_5$ are substantially parallel to one another and to the exhaust-gas-treatment-arrangement longitudinal axis $L_1$ and that they overlap substantially completely in the axial direction. This means that an inlet region 58 of the exhaust-gas/reactant mixing section 26 is substantially in the same axial region as an outlet region 60 of an exhaust-gas treatment assembly 62 arranged in the flow path 14, and that an outlet region 64 of the exhaust-gas/reactant mixing section 26 is substantially in the same axial region as an inlet region 66 of an exhaust-gas treatment unit 68 arranged in the flow path 14. Similarly, the outlet region 64 of the exhaust-gas/reactant mixing section 26 is substantially in the same axial region as the inlet regions 48, 50 of the second exhaust-gas treatment units 40, 42, whereas the inlet region 58 of the exhaust-gas/reactant mixing section 26 is substantially in the same axial region as the outlet regions 52, 54 of the second exhaust-gas treatment units 40, 42.

In the embodiment illustrated, the exhaust-gas treatment unit 68 arranged in the flow path 14, or in the flow-path housing 16, includes a SCR catalytic converter unit 70 and one or/and at least one ammonia slip catalytic converter unit 72 that follow one another in the flow direction, or axially in the direction of the flow-path longitudinal axis $L_2$. The exhaust gas A introduced into the flow path 14 via the introduction housing 20 flows through the two catalytic converter units 70, 72 of the first exhaust-gas treatment unit 68 substantially in an exhaust-gas main flow direction $H_1$ in the flow path 14, with the exhaust-gas main flow direction $H_1$ in the flow path 14 being oriented substantially parallel to the flow-path longitudinal axis $L_2$. Of course, flow direction components which differ from this exhaust-gas main flow direction $H_1$ may be present, for example in regions in which swirling or turbulence occurs. A further reactant discharging unit may be arranged in the exhaust gas system 12 upstream of the exhaust-gas treatment arrangement 10 or the SCR catalytic converter unit 70, in order to introduce a reactant, for example a urea/water solution, into the exhaust gas flow upstream of the SCR catalytic converter unit 70.

An oxidation catalytic converter unit 74, in particular diesel oxidation catalytic converter unit, and a particle filter unit 76 of the exhaust-gas treatment assembly 62 are arranged one after the other in the flow direction downstream of the two catalytic converter units 70, 72 of the first exhaust-gas treatment unit 68. The exhaust gas A flowing through the flow path 14 flows substantially in the exhaust-gas main flow direction $H_1$ firstly through the oxidation catalytic converter unit 74 and then through the particle filter unit 76, before it is deflected by the first deflection housing 24 toward the exhaust-gas/reactant mixing section 26.

It should be pointed out that, in the case of the exhaust-gas treatment arrangement 10, both the first exhaust-gas treatment unit 68 and the exhaust-gas treatment assembly 62 may have different structures to that in the embodiment illustrated. Thus, for example, the first exhaust-gas treatment unit 68 could include only the SCR catalytic converter unit 70. The exhaust-gas treatment assembly 62 could, for example, include only the oxidation catalytic converter unit 74.

The exhaust-gas treatment arrangement 10 includes a hydrocarbon introduction assembly, denoted 78 in general, for introducing hydrocarbon K into the exhaust gas A flowing through the exhaust-gas treatment arrangement 10.

The hydrocarbon introduction assembly 78 includes a bypass flow channel 80, which in the embodiment illustrated adjoins the introduction housing 20 by way of a flow-channel inlet region 82 and thus receives some of the exhaust gases A, introduced into the introduction housing 20 or the exhaust-gas treatment arrangement 10, upstream of the flow path 14 or the first exhaust-gas treatment unit 68 arranged in the flow path 14. A flow-channel outlet region 84 of the bypass flow channel 80 is open toward the flow path 14 in a region axially between the first exhaust-gas treatment unit 68 and the exhaust-gas treatment assembly 62. The mixture of exhaust gas A and hydrocarbon K produced in the bypass flow channel 80 thus enters the flow path 14 in a region downstream of the first exhaust-gas treatment unit 68 and upstream of the exhaust-gas treatment assembly 62.

The hydrocarbon introduction assembly 78 includes a hydrocarbon discharging unit 86, which in general is also referred to or acts as an injector, assigned to the bypass flow channel 80. It injects the hydrocarbon K, for example in the form of a spray mist or in droplet form, into that portion of the exhaust gas introduced into the exhaust-gas treatment arrangement 10 that flows through the bypass flow channel 80.

In order to assist the mixing of exhaust gas A and hydrocarbon K in the region of the bypass flow channel 80, a swirling-flow generating unit 88, which circumferentially deflects the exhaust gas flow flowing through the bypass flow channel 80, may be provided upstream of the location O, where the hydrocarbon K is introduced into the bypass flow channel 80 by the hydrocarbon discharging unit 86, with the result that a swirling flow is produced already upstream of the location O. For example, the swirling-flow generating unit 88 may include a mixer with a plurality of baffle-like flow deflecting elements. As an alternative or in addition, a swirling-flow generating unit 90 or a mixer can also be arranged downstream of the location O, where the hydrocarbon K is introduced into the bypass flow channel 80.

An exhaust-gas-flow regulating unit 92 assigned to the bypass flow channel 80 is also provided. It may, for example include a butterfly valve 94 positioned close to the flow-channel inlet region 82 and upstream of the swirling-flow generating unit 88. Depending on the pivoting position of the butterfly valve 94, it can, for example, substantially completely prevent flow through the bypass flow channel 80 in a closed position or allow flow to occur through the bypass flow channel 80 to a maximum extent in an open position. Setting the butterfly valve 94 in one or more intermediate positions between the closed position and the open position makes it possible to regulate the proportion of exhaust gas conducted into the bypass flow channel 80. This also makes it possible to reduce or increase the amount of exhaust gas to adapt to the amount of hydrocarbon K introduced, in order in this way both to assist efficient mixing of the exhaust gas A and the hydrocarbon K and to ensure that, downstream of the first exhaust-gas treatment unit 68, a mixture of exhaust gas A and hydrocarbon K with a ratio that can be set in defined fashion is introduced into the flow path 14 and thus into that portion of the exhaust gas introduced into the exhaust-gas treatment arrangement 10 that enters the upstream end region 18 of the flow path 14.

The bypass flow channel 80 includes a channel portion 96 which is elongate in the direction of a flow-channel longitudinal axis $L_6$. This channel portion, or the flow-channel longitudinal axis $L_6$, extends substantially parallel to the flow-path longitudinal axis $L_2$, with the result that a substantial portion of extent of the bypass flow channel 80 and the flow path 14 extend substantially parallel to one another and so as to overlap one another axially, and thus the flow-channel inlet region 82 is approximately in the same axial region as the inlet region 66 of the first exhaust-gas treatment unit 68. As depicted in FIG. 3, this makes it possible to completely accommodate the bypass flow channel 80 within the outer circumferential contour of the entire exhaust-gas treatment arrangement 10 and thus leads to a compact structure.

A flow channel portion 98, extending for example substantially radially and leading into the flow-path housing 16 axially between the first exhaust-gas treatment unit 68 and the exhaust-gas treatment assembly 62, adjoins the flow channel portion 98 extending in the direction of the exhaust-gas-treatment-arrangement longitudinal axis $L_1$. In this way, the flow of exhaust gas A and hydrocarbon K leaving the bypass flow channel 80 is introduced approximately substantially radially or with a corresponding adjustment of the flow channel portion 98 in the circumferential direction approximately tangentially into the flow path 14, this contributing to further mixing with that portion of the exhaust gas A introduced into the exhaust-gas treatment arrangement 10 that flows through the first exhaust-gas treatment unit 68.

FIG. 2 indicates with dashed line that the bypass flow channel 80, in its flow-channel inlet region 82, could directly adjoin the flow path 14, or the flow path housing 16, in a region upstream of the first exhaust-gas treatment unit 68 by way of a substantially radially extending flow channel portion 100, and therefore could receive exhaust gas directly from the flow path 14 downstream of the introduction housing 20. It should also be pointed out that it would also be possible to arrange multiple bypass flow paths, which are spaced apart from one another for example in the circumferential direction around the flow-path longitudinal axis $L_2$ and have a respective assigned hydrocarbon discharging unit 86, assigned to the flow path 14. In this way, given bypass flow channels 80 which are nevertheless dimensioned with a smaller flow cross section than the flow cross section in the flow path 14 and the efficient mixing of exhaust gas A and hydrocarbon K achievable as a result, the amount of exhaust gas A to be mixed with hydrocarbon K can be increased.

In order to assist the mixing of the mixture of exhaust gas and hydrocarbon introduced into the flow path 14 from the bypass flow channel 80 with the exhaust gas conducted through the first exhaust-gas treatment unit 68, a swirling-flow generating unit 104 is provided at an outlet region 102 of the first exhaust-gas treatment unit 68. The swirling-flow generating unit includes, for example, a plurality of flow deflection elements 106, which extend substantially radially in relation to the flow-path longitudinal axis $L_2$ and circumferentially deflect the exhaust gas flowing through the first exhaust-gas treatment unit 68.

A flow distribution element 110 is provided at an inlet region 108 of the exhaust-gas treatment assembly 62. This substantially plate-like flow distribution element 110 has a multiplicity of flow through-openings 112 which have substantially the same dimensions or/and are distributed substantially evenly on the flow distribution element 110. The flow distribution element 110 evenly distributes the mixture of exhaust gas and hydrocarbon entering the exhaust-gas treatment assembly 62, in particular the oxidation catalytic converter unit 74, at the inlet region 108 over the cross section of the exhaust-gas treatment assembly 62 and makes it possible for this mixture to enter the exhaust-gas treatment assembly 62 with an even distribution.

Oxidizing the hydrocarbon K transported in the exhaust gas A in the oxidation catalytic converter unit 74 causes a release of heat, which for the one part contributes to heating the oxidation catalytic converter unit 74 and thus ensures that the latter is quickly brought to the operating temperature required for the catalytic reaction or is efficiently kept at this temperature. For the other part, some of this heat can be borne toward the downstream system regions, in particular the exhaust-gas/reactant mixing section 26 and the second exhaust-gas treatment units 40, 42, by the exhaust gas flowing through the oxidation catalytic converter unit 74.

This can contribute to increased evaporation of the reactant R, which is sprayed-in in liquid form, in the exhaust-gas/reactant mixing section 26. In the second exhaust-gas treatment units 40, 42, their respective SCR catalytic converter units 114, 116 can be efficiently heated and brought to the temperature required for the SCR reaction more quickly, or kept at this temperature.

The structure according to the disclosure of an exhaust-gas treatment arrangement ensures, both by virtue of the addition of hydrocarbon to the exhaust-gas flow and by virtue of efficient mixing of the hydrocarbon with the exhaust gas flowing in the exhaust-gas treatment arrangement, that oxidation of the hydrocarbon distributed over a large surface area makes it possible to release heat substantially uniformly, and the heat can be used to heat various system regions of the exhaust-gas treatment arrangement 10 that are intended for conducting catalytic reactions. The integration of the hydrocarbon introduction assembly in the flow path in the manner described above achieves, or maintains, a compact configuration of the exhaust-gas treatment arrangement which allows for the flow principle that the exhaust-gas main flow direction $H_1$ in the flow path also including the hydrocarbon introduction assembly is aligned substantially in the opposite direction to an exhaust-gas main flow direction $H_4$ in the exhaust-gas/reactant mixing section, while an exhaust-gas main flow direction $H_5$ in the second exhaust-gas treatment units is aligned in the same direction as the exhaust-gas main flow direction $H_1$ in the flow path, but in the opposite direction to the exhaust-gas main flow direction $H_4$ in the exhaust-gas/reactant mixing section. This makes it possible to ensure that the statutory limit values for proportions of pollutants in the exhaust gas can be achieved or maintained under a wide variety of different operating circumstances of an internal combustion engine or the exhaust gas system together with an axially very compact structure owing to the introduction of hydrocarbon and owing to the efficient mixing of the hydrocarbon with the exhaust gas.

It is understood that the foregoing description is that of the preferred embodiments of the invention and that various changes and modifications may be made thereto without departing from the spirit and scope of the invention as defined in the appended claims.

The invention claimed is:

1. An exhaust-gas treatment arrangement for an exhaust gas system of an internal combustion engine including a diesel internal combustion engine, the exhaust-gas treatment arrangement defining a flow path and comprising:

an introduction housing for introducing exhaust gas into the exhaust-gas treatment arrangement, said flow path having an upstream end region adjoining said introduction housing;

a first exhaust-gas treatment unit;

an exhaust-gas treatment assembly downstream of said first exhaust-gas treatment unit;

said first exhaust-gas treatment unit and said exhaust-gas treatment assembly being arranged axially one after the other in a direction of a longitudinal axis ($L_2$) of said flow path with said flow path including said first exhaust-gas treatment unit and said exhaust-gas treatment assembly;

a hydrocarbon introduction assembly for introducing hydrocarbon into exhaust gas flowing through said exhaust-gas treatment arrangement;

said hydrocarbon introduction assembly including a bypass flow channel having a flow-channel inlet region for receiving exhaust gas upstream of said first exhaust-gas treatment unit and a flow-channel outlet region for discharging at least one of the following:

i) exhaust gas; and, ii) hydrocarbon into said flow path downstream of said first exhaust-gas treatment unit and upstream of said exhaust-gas treatment assembly, so that the exhaust gas received in the bypass flow channel bypasses that first exhaust-gas treatment unit;

said hydrocarbon introduction assembly further including a hydrocarbon discharging unit for discharging hydrocarbon into said bypass flow channel; and, wherein said flow-channel inlet region of said bypass flow channel adjoins at least one of:

i) said introduction housing so as to permit receiving the exhaust gas from said introduction housing; and, ii) a portion of said flow path lying between said introduction housing and said first exhaust-gas treatment unit for receiving the exhaust gas from said flow path.

2. The exhaust-gas treatment arrangement of claim 1, further comprising a swirling-flow generating unit arranged in said bypass flow channel.

3. The exhaust-gas treatment arrangement of claim 2, wherein said swirling-flow generating unit is arranged upstream of said hydrocarbon discharging unit; and/or, a swirling-flow generating unit is arranged downstream of said hydrocarbon discharging unit.

4. The exhaust-gas treatment arrangement of claim 1, further comprising an exhaust-gas flow regulating unit assigned to said bypass flow channel.

5. The exhaust-gas treatment arrangement of claim 4, wherein said exhaust-gas-flow regulating unit includes a butterfly valve.

6. The exhaust-gas treatment arrangement of claim 1, wherein said bypass flow channel includes a flow channel portion extending in a direction of a flow channel longitudinal axis (L6) substantially parallel to said longitudinal axis ($L_2$) of said flow path; and, said hydrocarbon discharging unit is configured to discharge hydrocarbon into said flow channel portion.

7. The exhaust-gas treatment arrangement of claim 1, further comprising a second exhaust-gas treatment unit arranged downstream of said exhaust-gas treatment assembly.

8. The exhaust-gas treatment arrangement of claim 7, further comprising:

an exhaust-gas/reactant mixing section having a mixing channel elongated substantially in a direction of a mixing-section longitudinal axis ($L_3$);

a reactant discharging unit for discharging reactant into said mixing channel; and, said reactant discharging unit being provided downstream of said exhaust-gas treatment assembly and upstream of said second exhaust-gas treatment unit.

9. The exhaust-gas treatment arrangement of claim 8, wherein said mixing-section longitudinal axis ($L_3$) is substantially parallel to said longitudinal axis ($L_2$) of said flow-path, and/or wherein said flow path and said exhaust-gas/reactant mixing section overlap one another substantially completely in axial direction causing an inlet region of said exhaust-gas/reactant mixing section to be positioned substantially in a same axial region in the direction of said mixing-section longitudinal axis ($L_3$) as an outlet region of said exhaust-gas treatment assembly, and an outlet region of said exhaust-gas/reactant mixing section is positioned substantially in the same axial region in the direction of said mixing-section longitudinal axis ($L_3$) as an inlet region of said first exhaust-gas treatment unit.

10. The exhaust-gas treatment arrangement of claim 8, wherein an exhaust-gas main flow direction ($H_4$) in said mixing channel is aligned substantially in the opposite direction to an exhaust-gas main flow direction ($H_1$) in said flow path.

11. The exhaust-gas treatment arrangement of claim 7, wherein said second exhaust-gas treatment unit is elongated in a direction of an exhaust-gas-treatment-unit longitudinal axis ($L_4$, $L_5$) substantially parallel to said flow-path longitudinal axis ($L_2$) and can be flowed through substantially in the direction of said exhaust-gas-treatment-unit longitudinal axis ($L_4$, $L_5$), and/or wherein said second exhaust-gas treatment unit and said exhaust-gas/reactant mixing section overlap one another substantially in axial direction causing an inlet region of said exhaust-gas/reactant mixing section to be positioned substantially in a same axial region in the direction of said mixing-section longitudinal axis ($L_3$) as an outlet region of said second exhaust-gas treatment unit, and said outlet region of said exhaust-gas/reactant mixing section is positioned substantially in the same axial region in the direction of said mixing-section longitudinal axis ($L_3$) as an inlet region of said second exhaust-gas treatment unit.

12. The exhaust-gas treatment arrangement of claim 11, further comprising first and second flow deflection housings; and, wherein said inlet region of said exhaust-gas/reactant mixing section is connected to said outlet region of said exhaust-gas treatment assembly via said first flow deflection housing and said outlet region of said exhaust-gas/reactant mixing section is connected to said inlet region of said second exhaust-gas treatment unit via said second flow deflection housing.

13. The exhaust-gas treatment arrangement of claim 11, wherein two second exhaust-gas treatment units, which can be flowed through in parallel, are provided next to one another transversely in relation to said exhaust-gas-treatment-unit longitudinal axis ($L_4$, $L_5$) and so as to substantially completely overlap one another in a direction of said exhaust-gas-treatment-unit longitudinal axis ($L_4$, $L_5$).

14. The exhaust-gas treatment arrangement of claim 7, wherein said second exhaust-gas treatment unit includes an SCR catalytic converter unit and/or at least one ammonia slip catalytic converter unit and/or wherein said exhaust-gas treatment assembly includes an oxidation catalytic converter unit and/or a particle filter unit.

15. The exhaust-gas treatment arrangement of claim 1, wherein said flow-channel inlet region is positioned in a same axial region as an inlet region of said first exhaust-gas treatment unit; and, the flow-channel outlet region lies axially between said first exhaust-gas treatment unit and said exhaust-gas treatment assembly.

16. The exhaust-gas treatment arrangement of claim 1, further comprising a swirling-flow generating unit having a plurality of flow deflection elements extending substantially radially in relation to said longitudinal axis ($L_2$) of said flow path; and, said swirling flow generator unit being arranged at an outlet region of said first exhaust-gas treatment unit, and/or wherein a flow distribution element having a multiplicity of flow through-openings with substantially the same dimensions and/or distributed substantially evenly on said flow distribution element; and, said flow distribution element being arranged at an inlet region of said exhaust-gas treatment assembly.

17. The exhaust-gas treatment arrangement of claim 1, wherein said first exhaust-gas treatment unit includes an SCR catalytic converter unit and/or at least one ammonia slip catalytic converter unit and/or wherein said exhaust-gas treatment assembly includes an oxidation catalytic converter unit and/or a particle filter unit.

18. An exhaust-gas treatment arrangement for an exhaust gas system of an internal combustion engine including a diesel internal combustion engine, the exhaust-gas treatment arrangement defining a flow path and comprising:

a first exhaust-gas treatment unit;

an exhaust-gas treatment assembly downstream of said first exhaust-gas treatment unit;

said first exhaust-gas treatment unit and said exhaust-gas treatment assembly being arranged axially one after the other in a direction of a longitudinal axis ($L_2$) of said flow path with said flow path including said first exhaust-gas treatment unit and said exhaust-gas treatment assembly;

a hydrocarbon introduction assembly for introducing hydrocarbon into exhaust gas flowing through said exhaust-gas treatment arrangement;

said hydrocarbon introduction assembly including a bypass flow channel having a flow-channel inlet region for receiving exhaust gas upstream of said first exhaust-gas treatment unit and a flow-channel outlet region for discharging at least one of the following:

i) exhaust gas; and, ii) hydrocarbon into said flow path downstream of said first exhaust-gas treatment unit and upstream of said exhaust-gas treatment assembly;

said hydrocarbon introduction assembly further including a hydrocarbon discharging unit for discharging hydrocarbon into said bypass flow channel;

wherein said exhaust-gas treatment arrangement further comprises:

at least one second exhaust-gas treatment unit arranged downstream of said exhaust-gas treatment assembly;

an exhaust-gas/reactant mixing section having a mixing channel elongated substantially in a direction of a mixing-section longitudinal axis ($L_3$);

a reactant discharging unit for discharging reactant into said mixing channel, said reactant discharging unit being provided downstream of said exhaust-gas treatment assembly and upstream of said at least one second exhaust-gas treatment unit.

19. An exhaust gas system for an internal combustion engine including a diesel internal combustion engine, the exhaust gas system comprising:

an exhaust-gas conduit conducting exhaust gas away from the combustion engine; and, an exhaust-gas treatment arrangement communicating with said exhaust-gas conduit and defining a flow path and including:

an introduction housing for introducing exhaust gas into the exhaust-gas treatment arrangement, said flow path having an upstream end region adjoining said introduction housing;

a first exhaust-gas treatment unit;

an exhaust-gas treatment assembly downstream of said first exhaust-gas treatment unit;

said first exhaust-gas treatment unit and said exhaust-gas treatment assembly being arranged axially one after the other in a direction of a longitudinal axis ($L_2$) of said flow path with said flow path including said first exhaust-gas treatment unit and said exhaust-gas treatment assembly;

a hydrocarbon introduction assembly for introducing hydrocarbon into exhaust gas flowing through said exhaust-gas treatment arrangement;

said hydrocarbon introduction assembly including a bypass flow channel having a flow-channel inlet region for receiving exhaust gas upstream of said first exhaust-gas treatment unit and a flow-channel outlet region for discharging at least one of the following:

i) exhaust gas; and, ii) hydrocarbon into said flow path downstream of said first exhaust-gas treatment unit and upstream of said exhaust-gas treatment assembly, so that the exhaust gas received in the bypass flow channel bypasses that first exhaust-gas treatment unit;

said hydrocarbon introduction assembly further including a hydrocarbon discharging unit for discharging hydrocarbon into said bypass flow channel; and, wherein said flow-channel inlet region of said bypass flow channel adjoins at least one of:

i) said introduction housing so as to permit receiving the exhaust gas from said introduction housing; and, ii) a portion of said flow path lying between said introduction housing and said first exhaust-gas treatment unit for receiving the exhaust gas from said flow path.

20. The exhaust-gas treatment arrangement of claim 18, wherein said mixing-section longitudinal axis ($L_3$) is substantially parallel to said longitudinal axis ($L_2$) of said flow-path, and/or wherein said flow path and said exhaust-gas/reactant mixing section overlap one another substantially completely in axial direction causing an inlet region of said exhaust-gas/reactant mixing section to be positioned substantially in a same axial region in the direction of said mixing-section longitudinal axis ($L_3$) as an outlet region of said exhaust-gas treatment assembly, and an outlet region of said exhaust-gas/reactant mixing section is positioned substantially in the same axial region in the direction of said mixing-section longitudinal axis ($L_3$) as an inlet region of said first exhaust-gas treatment unit.

21. The exhaust-gas treatment arrangement of claim 18, wherein an exhaust-gas main flow direction ($H_4$) in said mixing channel is aligned substantially in the opposite direction to an exhaust-gas main flow direction ($H_1$) in said flow path.

22. The exhaust-gas treatment arrangement of claim 18, wherein said at least one second exhaust-gas treatment unit is elongated in a direction of an exhaust-gas-treatment-unit longitudinal axis ($L_4$, $L_5$) substantially parallel to said flow-path longitudinal axis ($L_2$) and can be flowed through substantially in the direction of said exhaust-gas-treatment-unit longitudinal axis ($L_4$, $L_5$), and/or wherein said at least one second exhaust-gas treatment unit and said exhaust-gas/reactant mixing section overlap one another substantially in axial direction causing an inlet region of said exhaust-gas/reactant mixing section to be positioned substantially in a same axial region in the direction of said mixing-section longitudinal axis ($L_3$) as an outlet region of said at least one second exhaust-gas treatment unit, and said outlet region of said exhaust-gas/reactant mixing section is positioned substantially in the same axial region in the direction of said mixing-section longitudinal axis ($L_3$) as an inlet region of said at least one second exhaust-gas treatment unit.

23. The exhaust-gas treatment arrangement of claim 22, further comprising first and second flow deflection housings; and, wherein said inlet region of said exhaust-gas/reactant mixing section is connected to said outlet region of said exhaust-gas treatment assembly via said first flow deflection housing and said outlet region of said exhaust-gas/reactant mixing section is connected to said inlet region of said at least one second exhaust-gas treatment unit via said second flow deflection housing.

24. The exhaust-gas treatment arrangement of claim 22, wherein said at least one second exhaust-gas treatment unit comprises two second exhaust-gas treatment units, which can be flowed through in parallel, are provided next to one another transversely in relation to said exhaust-gas-treatment-unit longitudinal axis ($L_4$, $L_5$) and so as to substantially completely overlap one another in a direction of said exhaust-gas-treatment-unit longitudinal axis ($L_4$, $L_5$).

25. The exhaust-gas treatment arrangement of claim 18, wherein at least one of said first and second exhaust-gas treatment units includes an SCR catalytic converter unit and/or at least one ammonia slip catalytic converter unit and/or wherein said exhaust-gas treatment assembly includes an oxidation catalytic converter unit and/or a particle filter unit.

26. An exhaust gas system for an internal combustion engine including a diesel internal combustion engine, the exhaust gas system comprising:

an exhaust-gas conduit conducting exhaust gas away from the combustion engine; and, an exhaust-gas treatment arrangement communicating with said exhaust-gas conduit and defining a flow path and including:

a first exhaust-gas treatment unit;

an exhaust-gas treatment assembly downstream of said first exhaust-gas treatment unit;

said first exhaust-gas treatment unit and said exhaust-gas treatment assembly being arranged axially one after the other in a direction of a longitudinal axis ($L_2$) of said flow path with said flow path including said first exhaust-gas treatment unit and said exhaust-gas treatment assembly;

a hydrocarbon introduction assembly for introducing hydrocarbon into exhaust gas flowing through said exhaust-gas treatment arrangement;

said hydrocarbon introduction assembly including a bypass flow channel having a flow-channel inlet region for receiving exhaust gas upstream of said first exhaust-gas treatment unit and a flow-channel outlet region for discharging at least one of the following:

i) exhaust gas; and, ii) hydrocarbon into said flow path downstream of said first exhaust-gas treatment unit and upstream of said exhaust-gas treatment assembly; and, said hydrocarbon introduction assembly further including a hydrocarbon discharging unit for discharging hydrocarbon into said bypass flow channel;

wherein said exhaust-gas treatment arrangement further comprises:

at least one second exhaust-gas treatment unit arranged downstream of said exhaust-gas treatment assembly;

an exhaust-gas/reactant mixing section having a mixing channel elongated substantially in a direction of a mixing-section longitudinal axis ($L_3$);

a reactant discharging unit for discharging reactant into said mixing channel, said reactant discharging unit being provided downstream of said exhaust-gas treatment assembly and upstream of said at least one second exhaust-gas treatment unit.

27. An exhaust-gas treatment arrangement for an exhaust gas system of an internal combustion engine including a diesel internal combustion engine, the exhaust-gas treatment arrangement defining a flow path and comprising:

a first exhaust-gas treatment unit;

an exhaust-gas treatment assembly downstream of said first exhaust-gas treatment unit;

said first exhaust-gas treatment unit and said exhaust-gas treatment assembly being arranged axially one after the other in a direction of a longitudinal axis ($L_2$) of said flow path with said flow path including said first exhaust-gas treatment unit and said exhaust-gas treatment assembly;

a hydrocarbon introduction assembly for introducing hydrocarbon into exhaust gas flowing through said exhaust-gas treatment arrangement;

said hydrocarbon introduction assembly including a bypass flow channel having a flow-channel inlet region for receiving exhaust gas upstream of said first exhaust-gas treatment unit and a flow-channel outlet region for discharging at least one of the following:

i) exhaust gas; and, ii) hydrocarbon into said flow path downstream of said first exhaust-gas treatment unit and upstream of said exhaust-gas treatment assembly, so that the exhaust gas received in the bypass flow channel bypasses that first exhaust-gas treatment unit;

said hydrocarbon introduction assembly further including a hydrocarbon discharging unit for discharging hydrocarbon into said bypass flow channel; and wherein said first exhaust-gas treatment unit includes an SCR catalytic converter unit and wherein said exhaust-gas treatment assembly includes an oxidation catalytic converter unit.

28. The exhaust-gas treatment arrangement of claim 27, wherein said first exhaust-gas treatment unit includes at least one ammonia slip catalytic converter unit and/or wherein said exhaust-gas treatment assembly includes a particle filter unit.

29. An exhaust gas system for an internal combustion engine including a diesel internal combustion engine, the exhaust gas system comprising:

an exhaust-gas conduit conducting exhaust gas away from the combustion engine; and, an exhaust-gas treatment arrangement communicating with said exhaust-gas conduit and defining a flow path and including:

a first exhaust-gas treatment unit;

an exhaust-gas treatment assembly downstream of said first exhaust-gas treatment unit;

said first exhaust-gas treatment unit and said exhaust-gas treatment assembly being arranged axially one after the other in a direction of a longitudinal axis ($L_2$) of said flow path with said flow path including said first exhaust-gas treatment unit and said exhaust-gas treatment assembly;

a hydrocarbon introduction assembly for introducing hydrocarbon into exhaust gas flowing through said exhaust-gas treatment arrangement;

said hydrocarbon introduction assembly including a bypass flow channel having a flow-channel inlet region for receiving exhaust gas upstream of said first exhaust-gas treatment unit and a flow-channel outlet region for discharging at least one of the following:

i) exhaust gas; and, ii) hydrocarbon into said flow path downstream of said first exhaust-gas treatment unit and upstream of said exhaust-gas treatment assembly, so that the exhaust gas received in the bypass flow channel bypasses that first exhaust-gas treatment unit;

said hydrocarbon introduction assembly further including a hydrocarbon discharging unit for discharging hydrocarbon into said bypass flow channel; and wherein said first exhaust-gas treatment unit includes an SCR catalytic converter unit and wherein said exhaust-gas treatment assembly includes an oxidation catalytic converter unit.

* * * * *